US007703644B2

(12) United States Patent
Ehrengruber et al.

(10) Patent No.: US 7,703,644 B2
(45) Date of Patent: Apr. 27, 2010

(54) SLIDE PLATE

(75) Inventors: Reinhard Ehrengruber, Reussbühl (CH); Carl Hoffmann, Marktredwitz (DE); Robert Sherriff, Oberaich (AT)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 245 days.

(21) Appl. No.: 11/569,733

(22) PCT Filed: Sep. 16, 2005

(86) PCT No.: PCT/EP2005/009956

§ 371 (c)(1),
(2), (4) Date: Nov. 28, 2006

(87) PCT Pub. No.: WO2006/042596

PCT Pub. Date: Apr. 27, 2006

(65) Prior Publication Data

US 2007/0241486 A1 Oct. 18, 2007

(30) Foreign Application Priority Data

Oct. 18, 2004 (DE) ..... 10 2004 050 702

(51) Int. Cl.
*B22D 41/08* (2006.01)

(52) U.S. Cl. ..... 222/600

(58) Field of Classification Search ..... 222/600
See application file for complete search history.

(56) References Cited

U.S. PATENT DOCUMENTS 5,335,833 A * 8/1994 Rancoule ..... 222/600
5,373,976 A * 12/1994 Rancoule et al. ..... 222/600
6,263,897 B1 7/2001 Sacki et al.

FOREIGN PATENT DOCUMENTS

| | | | |
|---|---|---|---|
| DE | 100 06 939 | C1 | 3/2001 |
| DE | 103 06 037 | A1 | 8/2004 |
| EP | 0 529 108 | A | 3/1993 |
| JP | 07 308756 | A | 11/1995 |
| JP | 07 308757 | A | 11/1995 |
| JP | 09 057428 | A | 3/1997 |
| WO | 02/070173 | A | 9/2002 |

OTHER PUBLICATIONS

Wilfried Deilmann., et al., "On Further Developments of Basic Ceramic Components in Sliding-Gate System", Radex Rundschau, Graefelfing, DE, vol. 27, 1979, pp. 1156-1168, Dec. 1979.

* cited by examiner

*Primary Examiner*—Scott Kastler
(74) *Attorney, Agent, or Firm*—Christpher L. Parmelee; Walker & Jocke

(57) ABSTRACT

A process for manufacturing a sliding plate for a valve closure on metallurgical melt containers may include forming the sliding plate by: integrating in a pressing procedure with a press, a pre-pressed annular insert made of a refractory ceramic material in a base body made of a refractory ceramic material; and removing the sliding plate from the press, resulting in an annular gap between a circumferential surface of the insert and a corresponding surface of the base body. The process may also include impregnating a transition area including the annular gap between the insert and the base body with an impregnation agent, and tempering the plate at temperatures between 200° C. and 700° C. to cause the impregnation agent to create a non-positive direct connection between the base body and the insert.

10 Claims, 2 Drawing Sheets

SLIDE PLATE

The invention relates to a sliding plate for a sliding gate of a metallurgical melting vessel.

Sliding plates, which includes plates for linear operating valves as well as for rotary valves, have been used for decades for regulating the discharge of metallurgical melting vessels, e.g., ladles or so-called tundishes.

Such sliding valve (valve systems) comprises, e.g., two plates, a stationary plate and a movable plate. Both plates have at least one flowthrough opening for an associated metallic melt, whereby the opening runs vertically to the main surfaces of the plates. The plates can move relative to one another so that corresponding openings of the plates can be arranged offset, partially overlapping or flush with each other in order to adjust the mass of the melt being guided through or to interrupt the melt flow.

Sliding gate systems with more than two plates are also known.

The wall area, in particular, of the flowthrough openings experiences wear in the course of use. In order to improve the resistance to wear (but also for purposes of repair), it is known to arrange an annular insert of an especially wear-resistant material around the passage opening in the base body of the plate. The "connection" of the insert to the surrounding refractory material of the base plate is problematic.

DE 100 06 939 C1 teaches mortaring the annular insert into a corresponding recess of the base body of the plate. This requires preparing the base plate in an appropriate mechanical manner, e.g., by boring. This causes additional costs. Furthermore, only rotationally symmetric inserts can be used.

DE 100 06 939 C1 also cites the possibility of pressing the annular insert by common pressing with the surrounding fire-resistant matrix material. In this embodiment, e.g., a prefabricated insert is placed into a press mold and surrounded by mass that is subsequently intended to form the base body. The mass is subsequently pressed. This process can be used in principle with any insert designs and is simple to carry out. However, it has the disadvantage that the insert and the surrounding base plate detach from one another after removal from the press and a small gap is produced between the insert and the base plate. Therefore, the insert may detach from the surrounding base body or even fall out when the sliding plate is used in a sliding valve.

A frequently employed process comprises casting of a fire-resistant hydraulic mass (a concrete) around a prefabricated insert body. Almost any insert geometries can also be used in this manner. However, when heated the hydraulic bond of the matrix material of the base body loses at least part of its strength. A strong ceramic bond is not produced until at temperatures distinctly above 1000° C. The term "strength hole", usually around 900° C., is used in this connection. During the use of the sliding plate a sharp temperature gradient forms between the area of the passage opening and the edge of the plate. In the area of the passage opening the fire-resistant (refractory) material assumes approximately the temperature of the liquid steel (e.g., 1600° C.). The temperature is distinctly lower on the edge of the plate. Thus, there are obligatorily areas within the plate that are heated only up to the "strength hole" (approximately 900° C.). The wear of these plates is correspondingly high.

Starting from this state of the art, it is an object of the invention to provide a sliding plate for a sliding valve of a metallurgical melting vessel which sliding plate comprises a wear-resistant insert in the area of the passage opening for the metallic melt whereby the sliding plate should be easily manufactured and provide a constant high strength (wear resistance) over its entire volume.

In order to solve this object the invention starts from the cited state of the art in which the insert is fixed in situ in the base body during pressing of a fire-resistant matrix material for the base body, which material surrounds the insert. As far as the insert is described below as "annular", this can be "exactly annular", resulting in a circular shape of the outer circumferential area of the insert. The term also includes shapes in which the insert is shaped in the axial direction of its opening between opposing front surfaces in a stepped manner on its outside, that is, with different outside diameters, or is shaped with a conical circumferential surface. "Annular" also includes asymmetrical circumferential shapes and an off-center arrangement of the opening. To this extent "annular" only means that the insert comprises an opening for transporting the metallic melt through it.

However, as described, a space (distance) is formed between the insert and the base body during removal, usually in the form of an annular gap between the circumferential surface of the insert and the corresponding surface of the base body, which space at least partially prevents a non-positive connection between the two. This space (gap) can also be a multipart gap.

The invention solves this problem in that the space present between the insert and the base body is filled with an impregnation agent that non-positively (directly) connects the base body to the insert.

Figure 1:
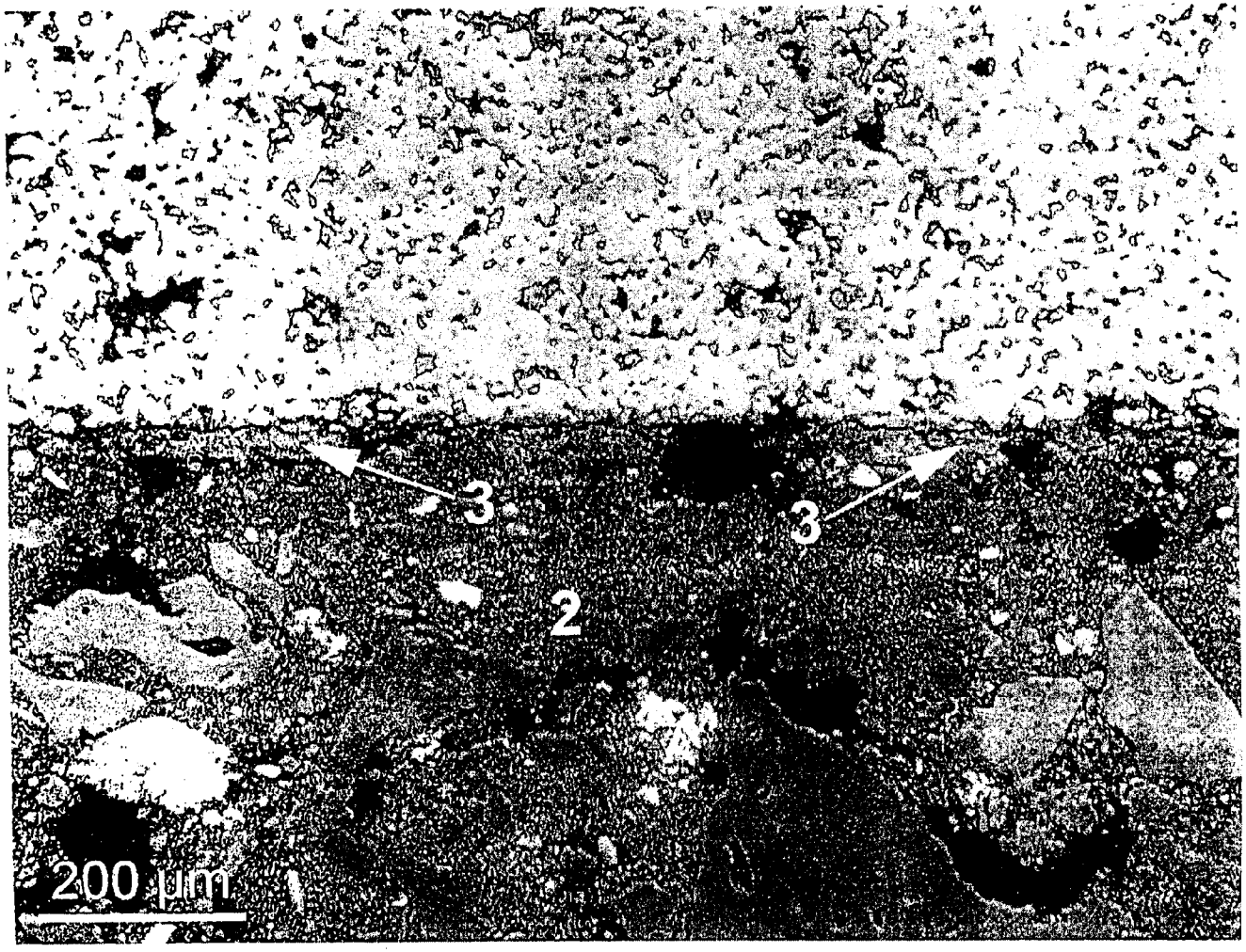
FIG. 1 shows the transition region between the insert (1) and body (2).

In its most general embodiment the invention relates to a sliding plate for a sliding valve of a metallurgical melting vessel with the following features:

a) The sliding plate comprises a base body (2) made of a refractory ceramic material,
b) The base body (2) comprises at least one passage opening running vertically to main surfaces of base body (2),
c) The base body (2) surrounds an annular insert (1) made of a refractory ceramic material,
d) The insert (1) surrounds the passage opening at least in an area of one main surface of the base body (2) completely and is aligned with this main surface,
e) A space (3) present between insert (1) and base body (2) is filled with an impregnation agent that non-positively connects base body (2) and insert (1).

The cited sections between the insert and the base body, in which no direct connection exists between the two parts, are generally very small and have a width of customarily <100 μm, frequently <10 μm. Such a narrow space (gap) can obviously not be filled with a mortar or the like. However, the use of a (liquid) impregnation agent makes it possible to fill this hollow space (these hollow spaces), and thus to connect the two parts to one another.

The space can be filled with a carbon-containing impregnation agent. Such an impregnation agent can be, e.g., a substance from the group: coal-tar pitch, petroleum pitch, phenolic resin.

If the sliding plate is impregnated (soaked) after the removal from the press with such a substance and if the plate is subsequently tempered at temperatures between 200 and 700° C., the impregnation agent cokes and solidifies, whereby it creates the desired non-positive direct connection between the annular insert and the surrounding base body. The gap or gaps between the two components are therefore connected by a continuous layer of carbon.

The impregnation can be limited to the cited transitional area between the insert and the base body. However, it is also possible to select the impregnation area to be greater, up to the impregnation of the entire plate.

The impregnation has the additional advantage that the tightness of the plate is increased in the entire impregnated area and its sliding properties are improved.

The impregnation can be optimized if the insert as well as the material of the base body have an open porosity between 5 and 20% by volume before the impregnation. As a rule, the open porosity of the base body will be greater than that of the insert since the insert is already used as a preformed, usually pre-pressed part.

The material selection as well as the pressing technique can be selected in such a manner that the space between the insert and the base body to be filled has a width ≦70 μm, e.g., between 20 and 70 μm. This can also be adjusted, e.g., by the selection of the granulation for the insert and for the base body.

Whereas the insert is generally used as a pre-pressed part the base body can also be manufactured by casting technology should the occasion arise. In this instance the gap is generally somewhat larger so that the width of the space (gap) between the insert and the base plate prior to the impregnation and after any drying of the plate can also be greater than the cited 100 μm.

For the rest, the features described in the state of the art regarding selection of material can also be transferred to the sliding plate in accordance with the invention. Thus, the insert generally has a greater wear resistance than the base body does. Thus, more economical material qualities can be used for the base body, which lowers the total price of the sliding plate.

The insert and the base body are customarily formed from different fire-resistant ceramic materials.

A suitable material for the insert is a substance based on $ZrO_2$. Materials based on, e.g., $Al_2O_3$ can be used for the base body.

Although the sliding plate can be manufactured with different process techniques, as explained above, a process proved to be advantageous in which a pre-pressed, annular insert made of a refractory ceramic material is integrated in a pressing procedure in a base body made of a refractory ceramic material, removed from the mold and the sliding plate formed in this manner is subsequently impregnated in the transition area between the insert and the base body with an impregnation agent and tempered.

Such a process was tested in the following test:

A calcined annular insert made of a zirconium oxide stabilized with MgO was placed in a press mold. The insert was subsequently surrounded with a press mass based on alumina in such an amount that the press mass (for forming the base body) extends past the front surface of the insert to such an extent that after the subsequent pressing procedure the upper front surface of the base body is in alignment with the upper front surface of the insert.

After the removal of the sliding plate pressed in this manner it was impregnated along a few millimeters on both sides of the transition area between the insert and the base body with liquid coal-tar pitch and subsequently tempered at 500° C.

As attached FIG. 1 shows, an approximately 5 μm-wide layer 3 of coked coal-tar pitch can be microscopically detected in the sharp transition region between insert 1 and base body 2.

This filling layer establishes a non-positive connection between the insert and the casing (base body). Thus, the insert is securely and reliably fixed relative to the base body. In a subsequent practice test the sliding plate could be tested together with a valve plate of the same construction in order to form a sliding gate system. 6 batches of steel were cast without the insert losing its non-positive connection in the base body.

Figure 2:
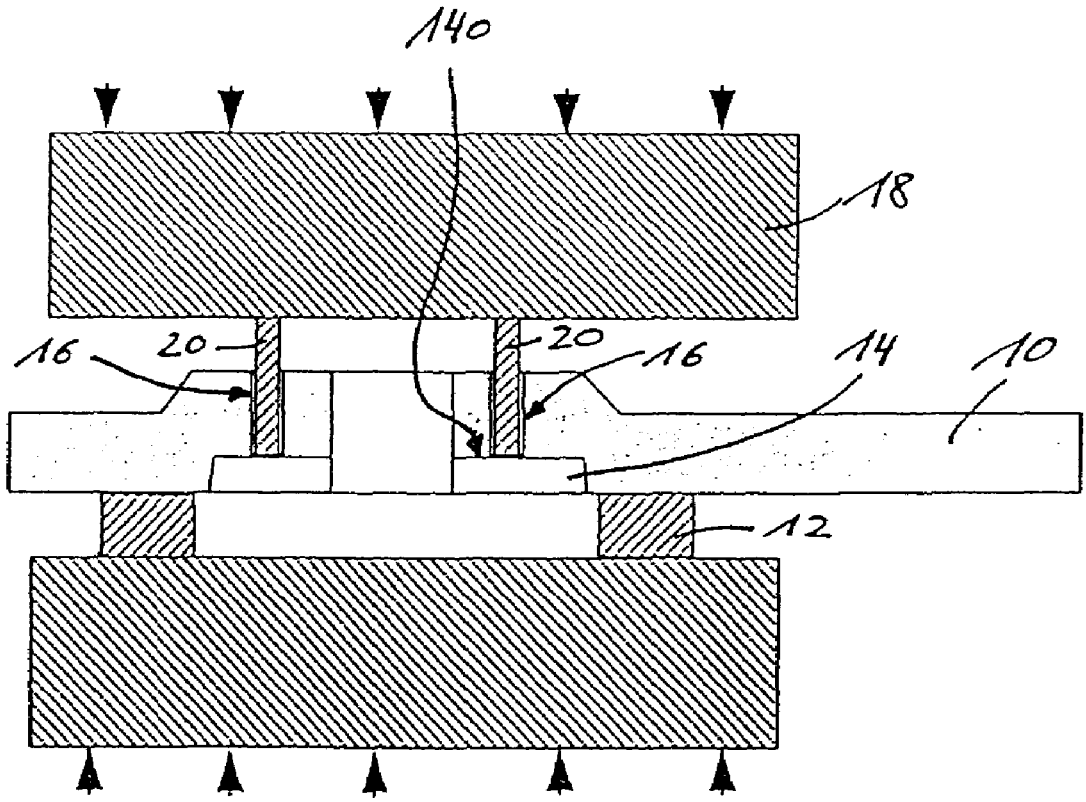
FIG. 2 shows an arrangement for the testing of the anchoring of the insert in a sliding plate.

The improved anchoring of the insert in a sliding plate was checked in the following test, as is shown in FIG. 2:

Plate 10 is placed on an annular ring 12, whereby the insert 14 is not resting on top of the ring. Insert 14 has an outer diameter of 130 mm, an inner diameter of the bore of 80 mm and is 15 mm thick. The plate is bored from above at six positions 16, located at uniform angular intervals on an imaginary circle, down to surface 14*o* of insert 14*k*. Die 18 with six corresponding pressure cylinders 20 is now introduced into the bores. The force was measured at which insert 14 is destroyed or breaks out of plate 10.

This measurement involved 5 tests on a sliding plate (E) designed in accordance with the invention and tempered at 500° C. and 5 tests on a sliding plate with the same construction without impregnation (S) and the average value for each plate was determined.

A value of 2±1 kN was determined for S and for E a value of 18±3 kN.

The insert can extend over the entire height of the sliding plate (vertically to the main surfaces). However, it is also possible to step the outside diameter of the insert ring in accordance with a corresponding stepping of the surrounding base body. In this manner an additional mechanical reliability is created, so that the ring rests securely on a corresponding collar of the base plate and can not loosen in the direction of flow of the metallic melt.

The invention claimed is:

1. A process for manufacturing a sliding plate for a sliding valve of a metallurgical melting vessel comprising:

a) forming the sliding plate by integrating in a pressing procedure with a press, a pre-pressed annular insert made of a refractory ceramic material in a base body made of a refractory ceramic material, such that the insert surrounds at least one passage opening of the base body at least in an area of one main surface of the base body completely and is aligned with this main surface, wherein the at least one passage opening extends between main surfaces of the base body, and removing the sliding plate from the press, now providing an annular gap between a circumferential surface of the insert and a corresponding surface of the base body, b) subsequent to (a), impregnating a transition area including the said annular gap between the insert and the base body with an impregnation agent, and c) subsequent to (b), tempering the plate at temperatures between 200° C. and 700° C. to cause the impregnation agent to create a non-positive direct connection between the base body and the insert.

2. The method according to claim 1, wherein in (b) the transition area is filled with a carbon-containing impregnation agent.

3. The method according to claim 1, wherein in (b) the transition area is filled with an impregnation agent from the group: coal-tar pitch, petroleum pitch, phenolic resin.

4. The method according to claim 1, wherein in (b) the transition area is a gap with a width <100 μm.

5. The method according to claim 1, wherein in (a) the base body is pressed.

6. The method according to claim 1, wherein (b) is carried out after removal of the plate from the press and prior to firing the plate to bond the insert to the base body.

7. The method according to claim 1, wherein in (a) the insert has a greater wear resistance than the base body.

8. The method according to claim 1, wherein in (a) the insert and the base body are made of different refractory, ceramic materials.

9. The method according to claim 1, wherein in (a) the insert is made of a material based on $ZrO_2$.

10. The method according to claim 1, wherein in (a) the base body is made of a material based on $Al_2O_3$.

* * * * *